US005243999A

United States Patent [19]

Smith

[11] Patent Number: 5,243,999

[45] Date of Patent: Sep. 14, 1993

[54] TOBACCO PROCESSING

[75] Inventor: Leigh A. B. Smith, Pfafftown, N.C.

[73] Assignee: R. J. Reynolds Tobacco Company, Winston-Salem, N.C.

[21] Appl. No.: 926,537

[22] Filed: Aug. 5, 1992

Related U.S. Application Data

[63] Continuation-in-part of Ser. No. 753,508, Sep. 3, 1991.

[51] Int. Cl.[5] ..... A24B 15/24

[52] U.S. Cl. ..... 131/297; 131/290; 131/298

[58] Field of Search ..... 131/290, 297, 298, 300, 131/291, 292, 293, 900, 901

[56] References Cited

U.S. PATENT DOCUMENTS 2,293,954 8/1942 Tiger ..... 131/297 X 3,561,451 2/1971 Jacin ..... 131/297

*Primary Examiner*—V. Millin
*Assistant Examiner*—J. Doyle
*Attorney, Agent, or Firm*—Bell, Seltzer, Park & Gibson

[57] ABSTRACT

Tobacco material is extracted with an extraction solvent to provide a aqueous extract and a tobacco portion insoluble in the solvent. The extract is separated from the insoluble portion and is provided within the water at a concentration at least about 30 percent, based on the weight of the extract and solvent. The extract and solvent are subjected to temperature treatment including reducing the temperature of the extract and solvent from a first temperature to a second temperature. Potassium nitrate crystals form as a precipitate and are separated from the extract and solvent. Then, the extract and solvent are contacted with activated carbon particles and separated therefrom.

24 Claims, 4 Drawing Sheets

TOBACCO PROCESSING

RELATED APPLICATION

The present application is a continuation-in-part of U.S. Ser. No. 07/753,508 filed Sep. 3, 1991, the disclosure of which is incorporated herein by reference.

BACKGROUND OF THE INVENTION

The present invention relates to tobacco, and in particular to a process for changing the character of tobacco extracts and tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Tobacco undergoes various processing steps prior to the time that it is used for cigarette manufacture. As such, cigarettes usually incorporate tobacco cut filler including certain amounts of processed reconstituted tobacco materials. Certain processed tobacco materials are cut rolled and cut puffed tobacco stems. Certain reconstituted tobacco materials are manufactured from tobacco stems, dust and scrap using papermaking processes. See, for example, U.S. Pat. Nos. 4,131,117 to Kite, et al.; 4,421,126 to Gellatly; 4,962,774 to Thomasson, et al. and 4,987,906 to Young, et al; as well as U.S. patent application Ser. No. 710,273, filed Jun. 4, 1991.

Oftentimes, tobacco is chemically or physically treated to selectively remove certain components therefrom. See, for example, U.S. Pat. Nos. 4,131,117 to Kite, et al., and 5,025,812 to Fagg, et al. and U.S. patent application Ser. No. 484,587, filed Feb. 23, 1990.

It would be desirable to provide a process for efficiently and effectively altering the chemical nature or composition of tobacco; and in particular, to provide a process for removing selected components from tobacco extracts or other types of tobacco materials.

SUMMARY OF THE INVENTION

The present invention relates to a process for changing the character of tobacco; in particular, to a process for removing certain components of tobacco extracts therefrom. The process involves extracting components from a tobacco material under extraction conditions using an extraction solvent having an aqueous character. As such, an aqueous tobacco extract and a water insoluble tobacco portion (i.e., extracted tobacco material) are provided. At least a portion of the aqueous extract is separated from the insoluble portion; and preferably, as much of the aqueous extract as possible is separated from the insoluble portion. The tobacco extract provided by such an extraction is provided within extraction solvent, preferably at a concentration of at least about 30 percent, based on the weight of extract and solvent. The extract and solvent is then subjected to temperature treatment including reducing the temperature of the extract from a first temperature to a second temperature. In one embodiment, the temperature treatment includes heating the extract and solvent to a first temperature (e.g., a temperature of at least about 50° C., and preferably a temperature of about 55° C. to about 95° C.). Then the temperature of the extract and solvent are reduced (i.e., cooled) to a second temperature under conditions sufficient to cause certain components of the extract to crystallize or to form a precipitate. Typically, the extract and solvent are cooled to a second temperature below about 45° C., preferably below about 30° C., and often below about 10° C. The crystalline material or precipitate is then separated from the extract and liquid solvent. The extract and solvent are then contacted with activated carbon particles and separated therefrom.

Alternatively, the temperature of the extract and solvent can be reduced from ambient temperature (e.g., 25° C. to 32° C.) to less than the freezing point of the extraction solvent to cause certain components of the extract to crystallize or precipitate. In this embodiment, the temperature of the extract and solvent is reduced to a second temperature below about 0° C. Then the crystalline material or precipitate is separated from the liquid solvent and extract and contacted with activated carbon particles.

In another embodiment the liquid solvent and extract can be contacted with the activated carbon particles to remove selective components from the tobacco extract and is then separated therefrom. The extract can be used as is or can be subjected to temperature treatment either in addition to or as an alternative to contacting the extract and solvent with the activated carbon particles after temperature treatment.

The liquid solvent and extract can be employed in the manufacture of smoking articles, such as cigarettes. For example, the liquid solvent and extract can be (i) spray dried or otherwise further processed, (ii) used in the manufacture of reconstituted tobacco materials, (iii) applied to the extracted tobacco material resulting from the previously described extraction of the tobacco material using the extraction solvent, or (iv) applied to substrates (e.g., alumina beads, gathered paper or nonwoven thermoplastic web).

DETAILED DESCRIPTION OF THE PREFERRED EMBODIMENTS

Figure 1:
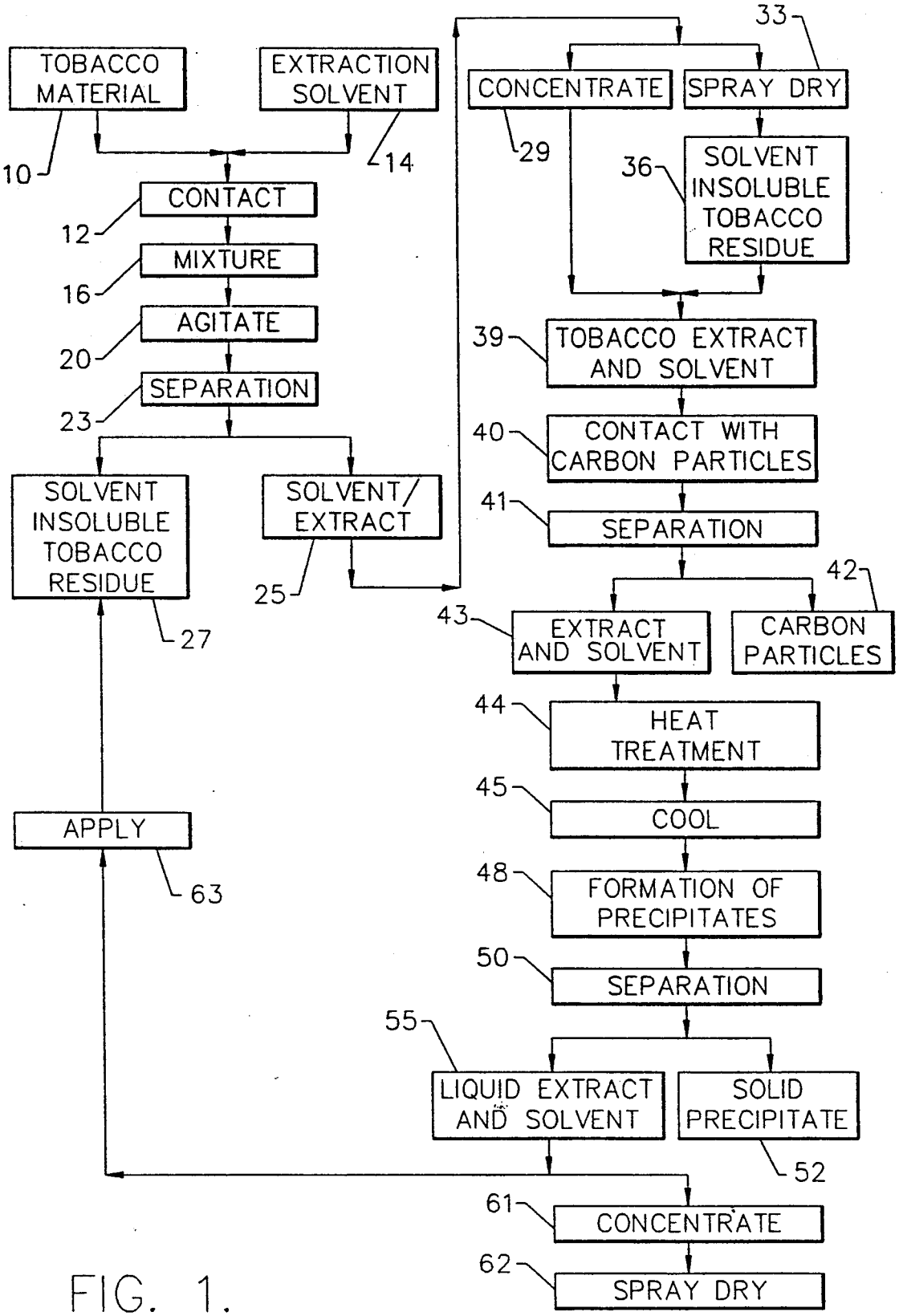
FIGS. 1–4 are schematic diagrams of process steps representative of embodiments of the present invention.

Referring to FIG. 1, tobacco material 10 (e.g., Burley tobacco stem) is contacted 12 with a liquid solvent 14 (e.g., tap water heated to about 50° C. to about 90° C.) resulting in a mixture 16 of solvent and tobacco material. The mixture 16 (e.g., slurry) can be agitated 20 in order to enhance removal (i.e., extraction) of water soluble components from the tobacco material 10 by the solvent 14. As such, the tobacco material is subjected to extraction conditions.

The mixture is subjected to separation conditions 23 so as to provide a tobacco extract within solvent (e.g., an aqueous tobacco extract 25) and a water insoluble tobacco residue 27 (e.g., extracted tobacco pulp). The aqueous tobacco extract 25 can be concentrated 29 (e.g., using vacuum techniques) for further processing. Alternatively, the aqueous tobacco extract can be spray dried 33, for storage and handling reasons, and later contacted 36 with extraction solvent for further processing.

Tobacco extract within solvent 39, which preferably is at a concentration above about 30 percent, based on the weight of extract and solvent, is contacted 40 one or more times with activated carbon particles and separated 41. The activated carbon particles 42 are discarded and the extract and solvent 43 are subjected to temperature treatment such as heat treatment 44. The heat treatment 44 involves heating the extract and solvent to a temperature above about 55° C. Then, the temperature of the heat treated liquid aqueous extract is reduced, i.e., cooled 45, so as to cause crystallization or formation of precipitates 48. Then the precipitates are separated 50 from the liquid solvent and extract (e.g., using filtration techniques or a centrifuge), thereby yielding collected solid precipitates 52 and a liquid solvent and extract 55 essentially absent of precipitates. Then, the liquid solvent and extract optionally is concentrated 61 and spray dried 62 for further use. Alternatively, the solvent and extract 55 is applied 63 (i.e., recombined) to the insoluble tobacco residue 27 or used to make a reconstituted sheet.

Figure 2:
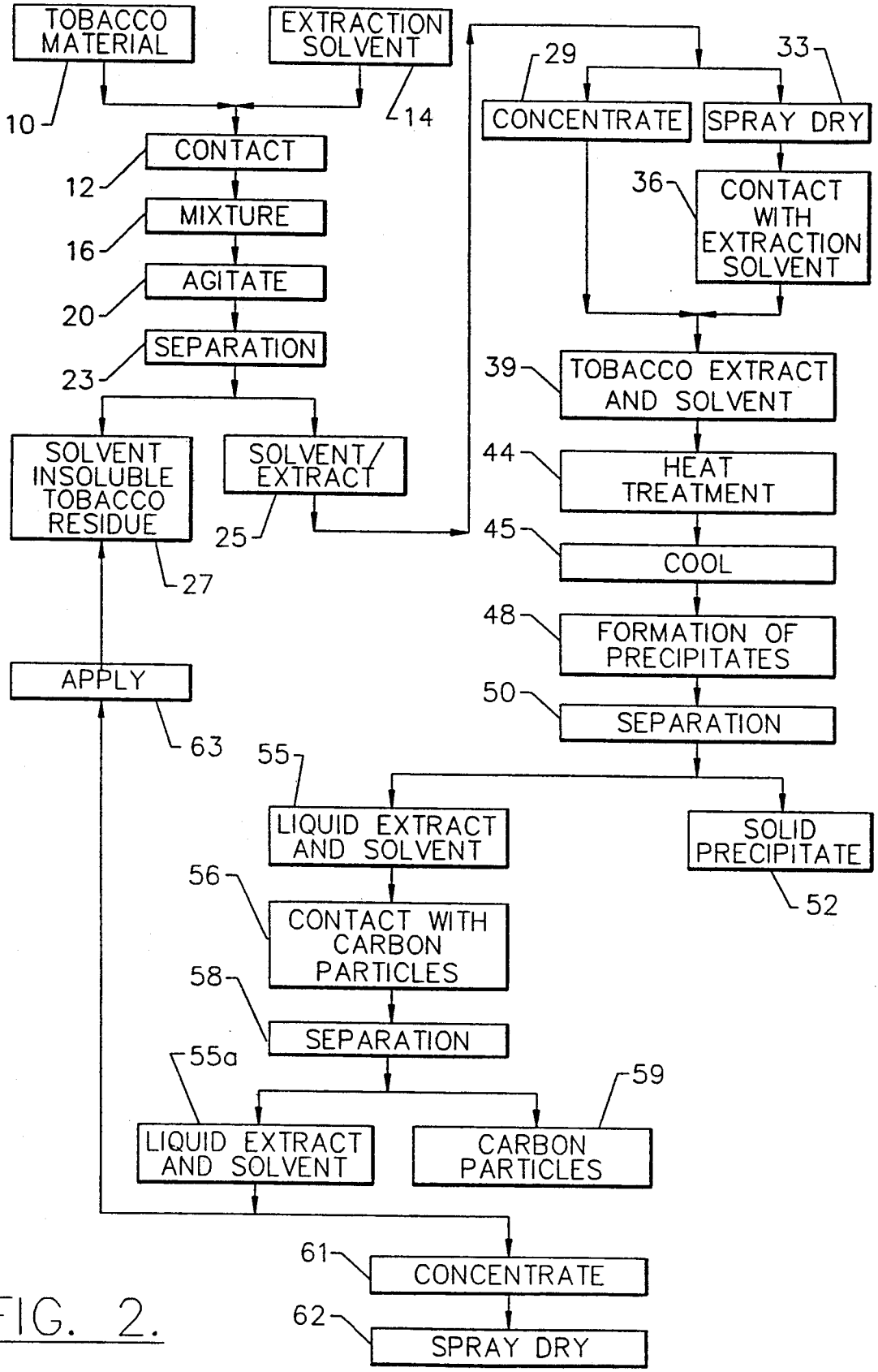

Referring to FIG. 2, another embodiment of the present invention is illustrated with like numerals indicating aspects common to those in FIG. 1. Tobacco material 10 is contacted 12 with the liquid solvent 14 resulting in a mixture 16 of solvent and tobacco material. The mixture 16 (e.g., slurry) can be agitated 20 in order to enhance removal of water soluble components from the tobacco material 10 by the solvent 14. As such, the tobacco material is subjected to extraction conditions.

The mixture is subjected to separation conditions 23 so as to provide a tobacco extract within solvent (e.g., an aqueous tobacco extract 25) and a water insoluble tobacco residue 27 (e.g., extracted tobacco pulp). The aqueous tobacco extract 25 is concentrated 29. Tobacco extract within solvent 39, which preferably is at a concentration above about 30 percent, based on the weight of extract and solvent, is subjected to heat treatment 44. Then, the temperature of the heat treated liquid aqueous extract is reduced, i.e., cooled 45, so as to cause crystallization or formation of precipitates 48. Then, the precipitates are separated 50 from the liquid solvent and extract thereby yielding collected solid precipitates 52 and a liquid solvent and extract 55 essentially absent of precipitates. The liquid solvent and extract 55 are contacted 56 one or more times with activated carbon particles, and separated 58. The activated carbon particles 59 are discarded and the liquid solvent and extract **55*a* can be concentrated 61 and spray dried 62 for further use or is applied 63 to the insoluble tobacco residue 27** or used to make a reconstituted sheet.

Figure 3:
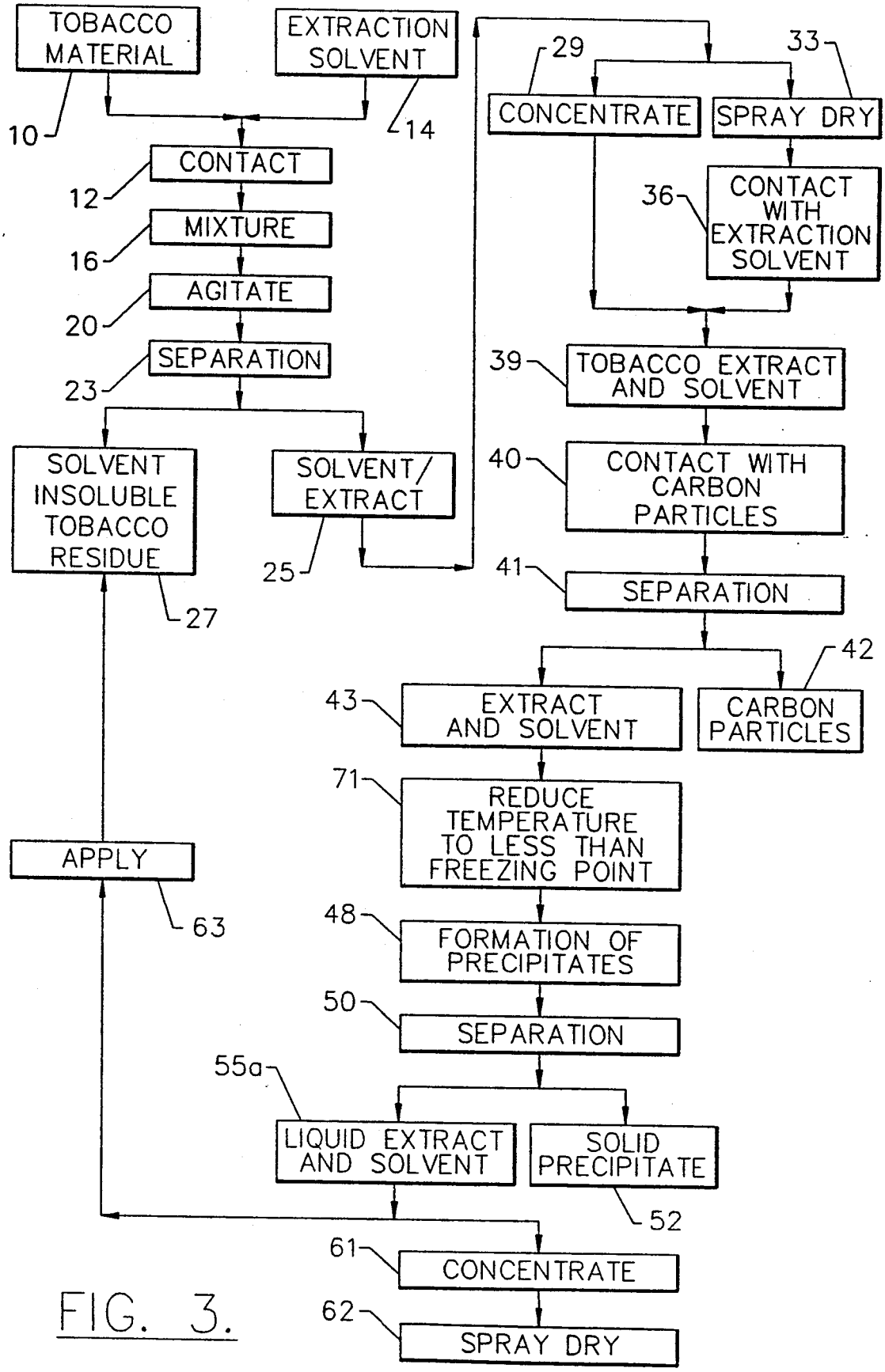

Referring to FIG. 3, still another embodiment of the present invention is illustrated with like numerals indicating aspects common to those in FIGS. 1 and 2. Tobacco material 10 is contacted 12 with a liquid solvent 14 resulting in a mixture 16 of solvent and tobacco material. The mixture 16 (e.g., slurry) can be agitated 20 in order to enhance removal of water soluble components from the tobacco material 10 by the solvent 14. As such, the tobacco material is subjected to extraction conditions.

The mixture is subjected to separation conditions 23 so as to provide a tobacco extract within solvent (e.g., an aqueous tobacco extract 25) and a water insoluble tobacco residue 27 (e.g., extracted tobacco pulp). The aqueous tobacco extract 25 can be concentrated 29 for further processing. Alternatively, the aqueous tobacco extract can be spray dried 33, for storage and handling reasons, and later contacted 36 with extraction solvent for further processing.

Tobacco extract within solvent 39, which preferably is at a concentration above about 30 percent, based on the weight of extract and solvent, contacted 40 one or more times with activated carbon particles and separated 41. The activated carbon particles 42 are discarded. The temperature of the tobacco extract within the solvent is reduced 71 from ambient temperature to below the freezing point of the extract and solvent so as to cause formation of precipitates 48. Then, the precipitates are separated 50 from the liquid solvent and extract thereby yielding collected solid precipitates 52 and a liquid solvent and extract **55*a* essentially absent of precipitates. Then, the liquid solvent and extract optionally is concentrated 61 and spray dried 62 for further use. Alternatively, the solvent and extract 55*a* is applied 63 to the insoluble tobacco residue 27** or used to make a reconstituted sheet.

Figure 4:
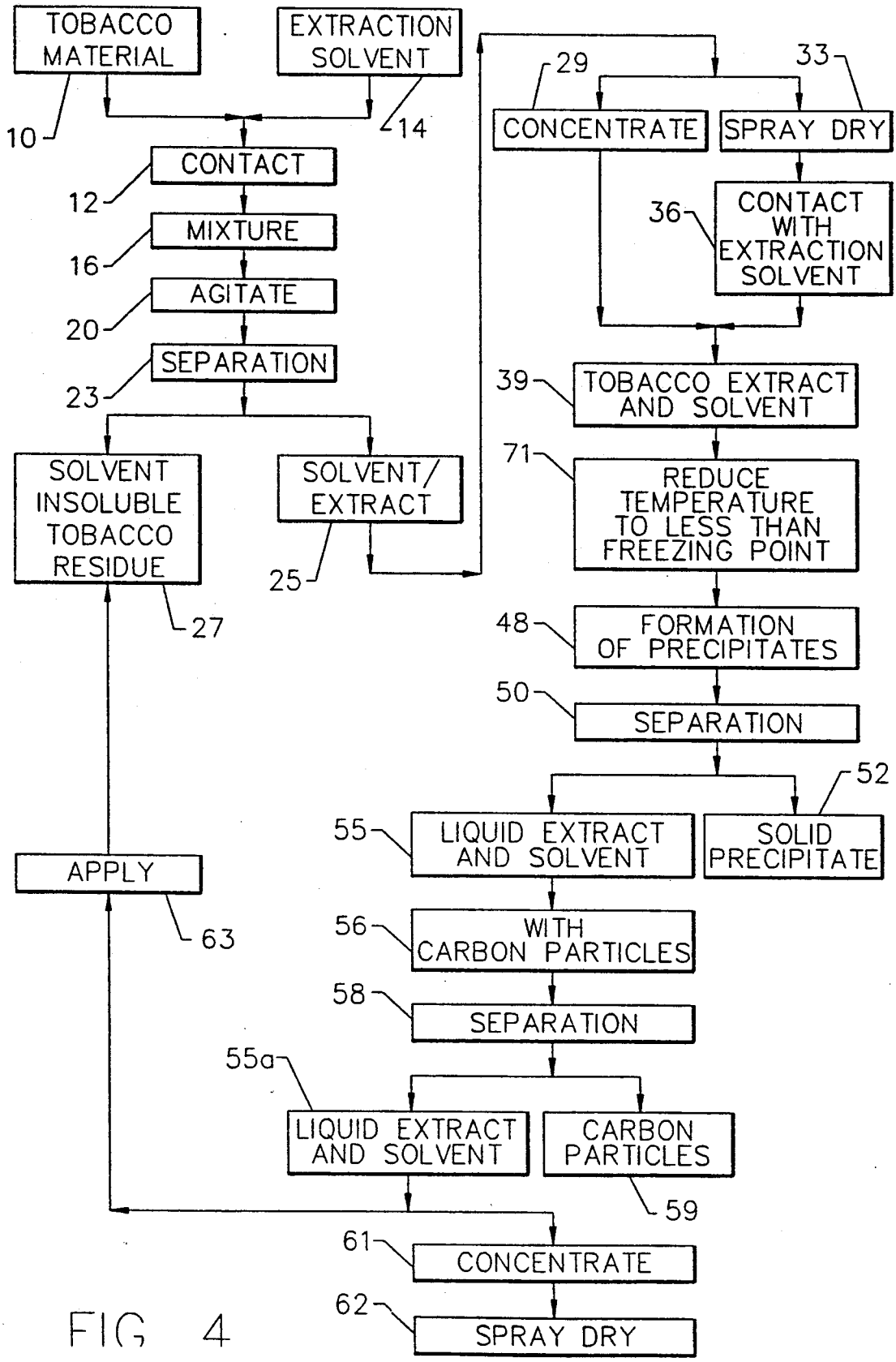

Referring to FIG. 4, yet another embodiment of the present invention is illustrated with like numerals indicating aspects common to those in FIGS. 1–3. Tobacco material 10 is contacted 12 with the liquid solvent 14 resulting in a mixture 16 of solvent and tobacco material. The mixture 16 (e.g., slurry) can be agitated 20 in order to enhance removal of water soluble components from the tobacco material 10 by the solvent 14. As such, the tobacco material is subjected to extraction conditions.

The mixture is subjected to separation conditions 23 so as to provide a tobacco extract within solvent (e.g., an aqueous tobacco extract 25) and a water insoluble tobacco residue 27 (e.g., extracted tobacco pulp). The aqueous tobacco extract 25 is concentrated 29. The temperature of the tobacco extract within the solvent is reduced 71 from ambient temperature to below the freezing point of the extract and solvent so as to cause crystallization or formation of precipitates 48. Then, the precipitates are separated 50 from the liquid solvent and extract thereby yielding collected solid precipitates 52 and a liquid solvent and extract 55 essentially absent of precipitates. The liquid solvent and extract 55 are contacted 56 one or more times with activated carbon particles, and separated 58. The activated carbon particles 59 are discarded and the liquid solvent and extract **55*a* can be concentrated 61 and spray dried 62 for further use or is applied 63 to the insoluble tobacco residue 27** or used to make a reconstituted sheet.

The tobacco material which is processed according to the process of the present invention can vary. The tobacco materials which are used are of a form such that, under extraction conditions, a portion thereof is soluble in (i.e., extracted by) the extraction solvent and a portion thereof is insoluble in (i.e., not extracted by) the extraction solvent. The type of tobacco can vary; however, the tobacco material typically is a Burley tobacco material or includes a blend of various types of tobacco materials including a Burley tobacco material. Normally, the tobacco has been aged. The tobacco material can be in the form of whole leaf, strip (e.g., laminae), cut filler, stem, cut or processed stem, scrap, dust, fines, stalk, or the like. The aforementioned tobacco materials can be processed separately, or as blends thereof. Typically, the tobacco material includes Burley tobacco stem or stem pieces.

The tobacco material is contacted with an extraction solvent, such as an extraction solvent having an aqueous character. A solvent having an aqueous character consists primarily of water, is normally greater than about 90 weight percent water, and can be essentially pure water in certain circumstances. Essentially pure water can include deionized water, distilled water or tap water. The extraction solvent can be a co-solvent mixture, such as a mixture of water and minor amounts of one or more solvents which are miscible therewith. The solvent can have pH adjusters, pH buffers, or other soluble or dispersible additives incorporated therein. Representative methods for extracting tobacco materials using solvents are set forth in U.S. Pat. Nos. 5,005,593 to Fagg; and 5,025,812 to Fagg, et al.; and U.S. patent application Ser. Nos. 505,339, filed Apr. 5, 1990; 484,587, filed Feb. 23, 1990; 680,207, filed Apr. 4, 1991; 720,308, filed Jun. 25, 1991; and 733,477, filed Jul. 22, 1991; which are incorporated herein by reference.

The amount of tobacco material which is contacted with the extraction solvent can vary. Typically, for a batch-wise extraction, the weight of extraction solvent relative to the tobacco material is greater than about 6:1, often greater than about 10:1, and frequently greater than about 15:1. Typically, for a continuous extraction, the weight of extraction solvent relative to tobacco material is greater than about 4:1, often greater than about 10:1, and frequently greater than about 14:1.

The conditions under which the extraction is performed can vary. Conditions of temperature can be less than, greater than, or equal to, ambient temperature. Typical temperatures range from about 5° C. to about 90° C., often about 10° C. to about 70° C. and frequently about 15° C. to about 65° C. The solvent/tobacco material mixture can be agitated (e.g., stirred, shaken or otherwise mixed) in order to increase the rate at which extraction occurs. Typically, for a batch-wise extraction, adequate extraction of components occurs in less than about 60 minutes, oftentimes in less than about 30 minutes.

The extraction solvent and tobacco extract then are separated from the insoluble tobacco residue. The manner of separation can vary; however, it is convenient to employ conventional separation techniques such as filtration, centrifugation, or the like. It is desirable to provide a solution of solvent and extract having a very low level of suspended solids. Preferably, the insoluble residue is treated so as to remove a large amount of solvent and tobacco extract therefrom.

The solvent and tobacco components extracted thereby can be filtered to remove suspended insoluble particles; concentrated; diluted with solvent; or spray dried, freeze dried, or otherwise processed, particularly for storage or handling reasons. Dried extracts, such as spray dried tobacco extracts, can be later redissolved in extraction solvent for later treatment and further extraction process steps.

The tobacco extract is provided within extraction solvent. The concentration of tobacco extract within extraction solvent most preferably is greater than that provided during extraction conditions. Typically, the concentration of extract within solvent is at least about 30 percent, often greater than about 35 and frequently greater than about 40 percent, based on the weight of extract and solvent. Typically, the concentration of extract within solvent is less than about 50 percent, and often less than about 45 percent, based on the weight of extract and solvent. The extract and solvent can be contacted with a water soluble phosphate salt or an ammonia compound our both. If desired, additives can be combined with the extract and solvent. For example, flavors, acids, sugars, syrups, and the like, can be combined with the extract and solvent.

The extract and solvent are contacted one or more times with activated carbon. The term "activated carbon" is intended to relate to carbon particles that have been subjected to conditions sufficient to increase the surface area of the carbon particles to facilitate absorbing different components. Such activation can be achieved chemically or by heating to a temperature of greater than about 800° C. Activated carbon typically has an internal surface area of from about 500 to about 1,500 $m^2/g$. Exemplary activated carbons include granular lignite or bituminous coal. Contact of the extract and solvent with activated carbon particles is provided by (i) contacting the extract and solvent with about 1 to about 20 weight percent activated carbon particles, or (ii) passing the extract and solvent through a activated carbon bed (e.g., a filter bed or column). Additionally, the activated carbon can be impregnated with certain flavorful agents and additives.

In one embodiment, the extract and solvent are subjected to temperature treatment in the form of heating to a first temperature significantly higher than ambient temperature. Typically, the extract and solvent are heated before or after contacting with activated carbon particles to a temperature of at least about 50° C., generally at least about 55° C., often at least about 60° C., and frequently at least about 65° C. Normally, the solvent and extract are not heated above about 120° C. Usually, the extract and solvent are heated to a temperature of about 50° C. to about 100° C., often about 55° C. to about 95° C., and frequently about 60° C. to about 85° C. The extract and solvent typically are heat treated under conditions of ambient pressure, although such heat treatment also can be performed in a pressure controlled environment (e.g., in a sealed high pressure vessel). The rate at which the extract and solvent are heated can vary, and often depends upon the type of equipment used to heat the extract and solvent. Manners and methods for heating extract and solvent will be apparent to the skilled artisan. The time period over which the extract and solvent are subjected to heat treatment at a particular maximum temperature can vary, and can range from relatively brief (e.g., less than one minute) to relatively long (e.g., about two hours, or more). Preferably, the extract and solvent are maintained at a maximum temperature of about 55° C. to about 95° C. for about 1 minute to about 1 hour.

After heat treatment has been performed, the extract and solvent are cooled to a second temperature. The rate of cooling can vary, and manners and methods for cooling extract and solvent will be apparent to the skilled artisan. Typically, the extract and solvent are cooled to a temperature below about 30° C., generally 25° C. to below ambient temperature (e.g., about 25° C. to about 32° C.) and often to below about 10° C. However, the extract and solvent after heat treatment normally are not cooled to below about 2° C. and often are not cooled to below about 5° C.

The temperature at which precipitates begin to form can vary, depending upon factors such as the concentration of the extract within the solvent, and temperature to which the extract and solvent are heated. For example, when the extract and solvent are heated to a temperature above about 70° C., precipitates typically begin to form when the extract and solvent reaches about 50° C., or less; and when the extract and solvent are heated to a temperature of about 50° C. to about 55° C., precipitates typically begin to form when the extract and solvent reaches about 35° C., or less.

In another embodiment, temperature treatment comprises reducing the temperature of the extract and solvent from a first ambient temperature (i.e, 25° C. to 32° C.) to less than the freezing point thereof before or after contacting with activated carbon particles. Typically, the freezing point of the extract and solvent approximates that of the pure solvent at ambient pressure. For example, if the pure water is the solvent, the temperature is reduced to at a second temperature below about 0° C. at ambient pressure.

The solid crystalline material or precipitate, which forms by heat treatment or by reducing the temperatures to below the freezing point, is insoluble in the liquid extract and the solvent and is separated from the extract and solvent. The manner of separation can vary, and can involve filtration (i.e., using cheesecloth), centrifugation, or other techniques which will be readily apparent to the skilled artisan.

The solvent and extract absent of precipitates can be employed in a variety of ways. For example, it is desirable to subject the liquid extract to a spray drying, freeze drying, belt drying, flash drying, or other suitable solvent removal process in order to provide a tobacco extract in a substantially solvent-free form. As such, the tobacco extract can be processed to have the form of a paste, a viscous liquid, a powder, a granular solid, a gel, or the like. Tobacco extracts can be processed (e.g., freeze dried or spray dried) as described in U.S. Pat. Nos. 3,316,919 to Green and 5,005,593 to Fagg; European patent application No. 338,831; as well as U.S. patent application Ser. No. 680,207 filed Apr. 4, 1991. Typically, tobacco extracts are provided in the form of spray dried extracts, freeze dried extracts, or the like. The precipitates can be used as fertilizer or any other applications for potassium nitrate crystals.

The tobacco extract can be provided at a predetermined solvent level (e.g., in a predetermined high moisture form) by removing the solvent from the collected mixture of solvent and extract. Vacuum distillation, reverse osmosis and thin film evaporation techniques are particularly useful. If desired, further solvent can be added to the tobacco extract. If desired, the extract can be employed to provide reconstituted tobacco materials or other types of processed tobacco materials by recombining the extract with the insoluble tobacco material or tobacco pulp provided during the extraction steps of the process of the present invention. For example, the extract can be recombined with tobacco pulp using the types of techniques described in U.S. patent application Ser. Nos. 484,587, filed Feb. 23, 1990; 710,273, filed Jun. 4, 1991 and 733,477, filed Jul. 22, 1991 which are incorporated herein by reference.

The tobacco extract can be subjected to further heat treatment as described in U.S. patent application Ser. Nos. 452,175, filed Dec. 18, 1989; 536,250, filed Jun. 11, 1990; and 710,273, filed Jun. 4, 1991, which are incorporated herein by reference.

The tobacco extracts so provided are useful as forms of tobacco for smoking products. For example, such tobacco extracts are useful as casing or top dressing components for tobacco laminae and cut filler, as well as for other smokable materials. Such tobacco extracts can be employed as a form of tobacco in those types of smokable materials described in U.S. Pat. No. 4,920,990 to Lawrence, et al., and European Patent Application Nos. 280,990 and 419,733. Alternatively, such tobacco extracts are useful as one form of tobacco employed in those types of smoking articles described in U.S. Pat. Nos. 4,708,151 to Shelar; 4,771,795 to White, et al.; 4,714,082 to Banerjee, et al.; 4,756,318 to Clearman, et al.; 4,793,365 to Sensabaugh, et al.; 4,827,950 to Banerjee, et al.; 4,819,665 to Roberts, et al.; 4,854,311 to Banerjee, et al.; 4,881,556 to Clearman, et al.; 4,893,639 to White, et al.; 4,928,714 to Shannon; 4,938,238 to Barnes, et al.; 4,947,874 to Brooks, et al.; 4,955,399 to Potter, et al.; 4,991,596 to Lawrence, et al.; and 5,027,837 to Clearman, et al.; U.S. patent application Ser. No. 642,233, filed Jan. 23, 1991; and European patent application No. 342,538. The tobacco extracts are useful as cigarette filter additives. For example, the tobacco extracts can be incorporated into low density polyethylene and formed into strands; and then incorporated into cigarette filters as described in U.S. Pat. Nos. 4,281,671 to Byrne, et al. and 4,862,905 to Green, Jr., et al. The tobacco extracts are also useful in those smoking articles described in U.S. patent application Ser. Nos. 606, 287, filed Nov. 11, 1990 and 621,499, filed Dec. 7, 1990. The tobacco extracts also are useful as cigarette wrapper additives; or as additives to the inner regions of cigarette packages (e.g., within a paper/foil laminate of a cigarette package or within a low density polyethylene film which is placed within a cigarette aroma and "pack aroma." See also, U.S. patent application Ser. No. 696,700, filed May 7, 1991.

The process can be used to remove significant amounts of potassium nitrate and various aldehydes from tobacco extracts provided by the extraction of Burley tobacco stems with a solvent having an aqueous character. For example, at least about 10 percent, up to about 88 percent and usually about 15 to about 65 percent of the potassium nitrate present in such an extract can be removed therefrom using the process of the present invention. Additionally, about 100 percent of the aldehydes can be removed.

The following examples are provided in order to further illustrate the invention but should not be construed as limiting the scope thereof. Unless otherwise noted, all parts and percentages are by weight.

EXAMPLE 1

A continuous counter current extractor available as CCE Model No. 1000 from Counter Current Technology Pty. Ltd. is provided. The trough of the extractor is filled with tap water at about 70° C. to about 75° C. The trough is positioned at 4° relative to horizontal so that tobacco material introduced at one end of the trough travels upwards during continuous extraction and water introduced at the other end of the trough travels downwards during continuous extraction. The screw of the extractor is standard for that extractor purchased, and a screen is positioned upstream from the tobacco material input region.

The screw is operated alternately for 20 seconds forward at a speed of 1.88 rpm and for about 15 seconds reverse at a speed of 1.88 rpm. The screw is not rotated (i.e., experiences a pause time for 1 second) each time the screw changes direction of operation. Burley tobacco stems are introduced continuously into the extractor at a rate of about 750 to about 800 pounds/hour, and tap water at about 70° C. to about 75° C. is fed continuously through the extractor at a rate of about 2,700 to about 3,000 pounds/hour.

The residence time of the stem material in the extractor averages about 40 to about 50 minutes. Wet extracted stems are removed from one end of the extractor, a liquid extract having a tobacco extract content of about 21.5 percent is collected at the other end of the extractor.

An aqueous tobacco extract is concentrated to a concentration of about 40 percent dissolved solids using a thin film evaporator. Then, the resulting concentrated aqueous extract is spray dried by continuously pumping the liquid aqueous extract to an Anhydro Size No. 1 spray dryer. The inlet temperature of the spray dryer is about 215° C. and the outlet temperature is about 85° C. The dried powder is collected at the outlet of the spray dryer. The spray dried extract exhibits a moisture content of about 5 percent. 5 lbs of EI-30 bituminous-based activated carbon particles available from Envirotrol, Inc. of Sewickly, Pa. is contacted with 62.5 lbs of spray dried extract and 62.5 lbs tap water (solvent), and agitated for 25 minutes. The activated carbon particles are separated from the extract and solvent using a centrifuge. The extract and solvent are contacted a second time with an additional 5 lbs of the EI-30 bituminous based activated carbon particles, and separated from the extract and solvent using a centrifuge.

The resulting liquid aqueous extract is then provided in a 55 gallon drum and subjected to temperature treatment by placing overnight in a freezer at about −5° C. at ambient pressure to reduce the temperature of the liquid aqueous extract from a first ambient temperature to a second temperature below about 0° C. The liquid aqueous extract then is separated from the solid potassium nitrate crystals that form. The nitrate content of the processed extract and solvent which is collected is about 3.43 percent. As such, about 37 percent of the nitrate is removed.

Cigarettes having a tobacco rod length of 70 mm and circumferences of 24.87 mm are prepared. The tobacco rod includes a charge of tobacco cut filler contained in a circumscribing cigarette paper wrap. The tobacco cut filler has the form of an "American blend", and the paper wrap is available as Reference No. 856 from Kimberly-Clark Corp.

The aqueous liquid extract is applied to the cut rolled extracted stem portion of the tobacco rod. In particular, about 0.689 lbs of extract per pound of extracted stem is applied to the stem portion of the cut filler. The blend so provided has a moisture content of about 12 to 13 percent and is mixed with the cut filler at about 20 percent by weight.

Upon smoking the cigarettes, the resulting cigarette mainstream smoke exhibited a flavor which is more pleasant relative to mainstream smoke of a similar cigarette not having the extract in intimate contact therewith. The relatively low level of the extract present in the cigarette acts to complement the flavor of the mainstream smoke, and does not provide an overpowering flavor or taste (i.e., undesirable off-taste) to the mainstream cigarette smoke.

EXAMPLE 2

62.5 lbs of spray dried Burley stem extract as provided in Example 1 is mixed with 62.5 lbs of tap water (solvent). 5 lbs of EI-30RL regenerated lignite-based activated carbon particles available from Envirotrol, Inc. is contacted with the spray dried/solvent mixture extract, and agitated for 25 minutes. The activated carbon particles are separated from the extract and solvent using a centrifuge. The extract and solvent are contacted a second time with an additional 5 lbs of EI-30RL regenerated lignite-based activated carbon particles, and separated from the extract and solvent using a centrifuge. Then, the resulting liquid aqueous extract at ambient temperature is provided in a 55 gallon drum and subjected to temperature treatment by placing overnight in a freezer at about −5° C. at ambient pressure to reduce the temperature of the liquid aqueous extract from a first ambient temperature to a second temperature below about 0° C. The liquid aqueous extract then is separated from the solid potassium nitrate crystals that form. The nitrate content of the processed extract and solvent which is collected is about 3.36 percent. As such, about 36 percent of the nitrate is removed.

Cigarettes having a tobacco rod length of 70 mm and circumference of 24.83 mm are prepared as in Example 1. The tobacco rod includes a charge of tobacco cut filler contained in a circumscribing cigarette paper wrap. The tobacco cut filler has the form of an "American blend", and the paper wrap is available as Reference No. 856 from Kimberly-Clark Corp.

The extract is applied to the cut rolled extracted stem portion of the tobacco rod. In particular, about 0.584 lbs of the extract per pound of extracted stem is prepared, and applied to the stem portion of the cut filler tobacco rod. The blend of tobacco material has a moisture content of about 12 to 13 percent and is then mixed with the cut filler at about 20 percent by weight.

Upon smoking the cigarettes, the resulting cigarette mainstream smoke exhibited a flavor which is more pleasant relative to mainstream smoke of a similar cigarette not having the extract in intimate contact therewith. The relatively low level of the extract present in the cigarette acts to complement the flavor of the mainstream smoke, and does not provide an overpowering flavor or taste (i.e., undesirable off-taste) to the mainstream cigarette smoke.

EXAMPLE 3

120 lbs spray dried Burley stem extract is provided as described in Example 1 and is contacted with 120 lbs tap water (solvent). The temperature of the extract and solvent is reduced from a first ambient temperature to a second temperature of about −5° C. by use of a continuous crystallizer available from Armstrong Engineering Associates, Inc. of West Chester, Pa. The aqueous tobacco extract then is separated from solid potassium nitrate crystals that form. 70 lbs of the denitrated aqueous tobacco extract is contacted with 5 lbs of EI-30 bituminous-based activated carbon particles and agitated for 30 minutes. The activated carbon particles are separated using a centrifuge.

Cigarettes having a tobacco rod length of 85 mm and circumference of 24.75 mm are prepared as in Example 1. The tobacco rod includes a charge of cut filler in the form of a paper sheet of aqueous tobacco extract recombined with extracted Burley tobacco stems, flue-cured stems, flue-cured scrap, flue-cured Burley scrap, Burley stems contained in a circumscribing cigarette paper wrap. The paper wrap is available as Reference No. 856 from Kimberly-Clark Corp.

EXAMPLE 4

287.25 lbs of Burley stem spray dried extract is provided as described in Example 1 and is contacted with 432 lbs of tap water (solvent). 58.5 lbs activated carbon particles comprising equal parts EI-30 bituminous-based activated carbon particles and EI-30RL regenerated lignite-based activated carbon particles is contacted with the liquid extract and solvent, and agitated for 25 minutes. The activated carbon particles are separated from the extract and solvent using a centrifuge.

Then, the resulting liquid aqueous extract at ambient temperature is provided in a 55 gallon drum and subjected to temperature treatment by placing overnight in a freezer at about −5° C. at ambient pressure to reduce the temperature of the liquid aqueous extract to below 0° C. The liquid aqueous extract then is separated from solid potassium nitrate crystals.

EXAMPLE 5

146 lbs of Burley stem spray dried extract is provided as described in Example 1 and is contacted with 220 lbs of tap water (solvent). The liquid aqueous extract at ambient temperature is provided in a jacketed stainless steel cooling tank and is subjected to temperature treatment by circulating cooling fluid through the jacket until the temperature of the liquid aqueous extract is reduced from a first ambient temperature to a second temperature below about 0° C., namely about −5° C. The liquid aqueous extract then is separated from solid potassium nitrate crystals. 20 lbs EI-30RL regenerated lignite-based activated carbon particles is contacted with the liquid extract and solvent, and agitated for 30 minutes. The activated carbon particles are separated from the extract and solvent using a centrifuge.

EXAMPLE 6

165 lbs of Burley stem spray dried extract is provided as described in Example 1, and is mixed with 165 lbs of tap water (solvent) and heated to a first temperature of about 95° C. for one hour. The mixture is cooled to a second temperature of about 10° C., and the potassium nitrate crystals separated from the liquid aqueous extract using a centrifuge.

255 lbs of the denitrated liquid aqueous extract is contacted with 51 lbs of EI-30RL regenerated lignite-based activated carbon particles and agitated for 30 minutes. The extract and the activated carbon particles are separated using a centrifuge. Cigarettes having a tobacco rod length of 70 mm and circumference of 24.75 mm are prepared as in Example 1. The tobacco rod includes a charge of tobacco cut filler contained in a circumscribing cigarette paper wrap. The tobacco cut filler has the form of an "American blend", and the paper wrap is available as Reference No. 856 from Kimberly-Clark Corp.

The aqueous liquid extract and extracted Burley stems are used to make a reconstituted tobacco sheet by a papermaking process which includes flue-cured stems, flue-cured scrap and Burley scrap is applied to the cut filler of the tobacco rod.

Upon smoking the cigarettes, the resulting cigarette mainstream smoke exhibited a flavor which is more pleasant relative to mainstream smoke of a similar cigarette not having the extract in intimate contact therewith. The relatively low level of the extract present in the cigarette acts to complement the flavor of the mainstream smoke, and does not provide an overpowering flavor or taste (i.e., undesirable off-taste) to the mainstream cigarette smoke.

That which is claimed is:

1. A process for removing components from a tobacco extract, the process comprising the steps of:

(i) extracting components from a tobacco material under extraction conditions using an extraction solvent having an aqueous character, so as to provide an aqueous tobacco extract and a tobacco portion insoluble in the solvent;

(ii) separating at least a portion of the aqueous tobacco extract from the tobacco portion insoluble in the solvent;

(iii) providing the tobacco extract within extraction solvent in an amount of at least about 30 weight parts extract per weight part of solvent;

(iv) subjecting the extract and solvent to temperature treatment including reducing the temperature of the extract and solvent from a first temperature to a second temperature;

(v) separating resulting precipitate from the extract and solvent;

(vi) contacting the extract and solvent with activated carbon particles; and (vii) separating at least a portion of the extract and solvent from the activated carbon particles.

2. The process of claim 1 whereby the tobacco material includes Burley tobacco stem and the precipitate includes potassium nitrate crystals.

3. The process of claim 1 or 2 whereby the temperature of the extract and solvent is reduced to less than 10° C.

4. The process of claim 1 or 2 whereby the extract and solvent are contacted with from about 1 to about 10 weight percent activated carbon particles in step (iv).

5. The process of claim 1 or 2 whereby the tobacco extract of step (iii) is contacted with a water soluble phosphate salt and/or an ammonia compound prior to step (iv).

6. A process for removing components from a tobacco extract, the process comprising the steps of:

(i) extracting components from a tobacco material under extraction conditions using an extraction solvent having an aqueous character so as to provide an aqueous tobacco extract and a tobacco portion insoluble in the solvent;

(ii) separating at least a portion of the aqueous tobacco extract from the tobacco portion insoluble in the solvent;

(iii) providing the separated tobacco extract within extraction solvent in an amount of at least about 30 weight percent, based an extract and extraction solvent weight;

(iv) contacting the extract and solvent with activated carbon particles;

(v) separating at least a portion of the extract and solvent from the activated carbon particles;

(vi) subjecting the separated extract and solvent to temperature treatment including reducing the temperature of the extract and solvent from a first temperature to a second temperature; and (vii) separating resulting precipitate from the extract solvent.

7. The process of claim 6 whereby the tobacco material includes Burley tobacco stem and the precipitate includes potassium nitrate crystals.

8. The process of claim 6 or 7 whereby the first temperature of step (vi) is above about 50° C.

9. The process of claim 6 whereby the second temperature is less than about 45° C.

10. The process of claim 6 or 7 whereby the second temperature of step (vi) is not below about 35° C.

11. The process of claim 6 or 7 whereby the first temperature of step (vi) is from about 55° C. to about 95° C.

12. The process of claim 6 or 7 whereby the extract and solvent are contacted with from about 1 to about 10 weight percent activated carbon particles in step (iv).

13. The process of claim 6 or 7 whereby the tobacco extract of step (iii) is contacted with a water soluble phosphate salt and/or an ammonia compound prior to step (iv).

14. A process for removing components from a tobacco extract, the process comprising the steps of:

(i) extracting components from a tobacco material under extraction conditions using an extraction solvent having an aqueous character, so as to provide an aqueous tobacco extract and a tobacco portion insoluble in the solvent;

(ii) separating at least a portion of the aqueous tobacco extract from the tobacco portion insoluble in the solvent;

(iii) providing the tobacco extract within extraction solvent in an amount of at least about 30 weight percent, based on extract and extraction solvent weight;

(iv) contacting the extract and solvent with activated carbon particles;

(v) separating at least a portion of the extract and solvent from the activated carbon particles;

(vi) subjecting the separated extract and solvent to heat treatment to above about 50° C.;

(vii) cooling the extract and solvent to less than about 45° C.; and (viii) separating resulting precipitate from the extract and solvent.

15. The process of claim 14 whereby the tobacco material includes Burley tobacco stem and the precipitate includes potassium nitrate crystals.

16. The process of claim 14 or 15 whereby the extract and solvent are not cooled to below about 5° C. in step (vii).

17. The process of claim 14 or 15 whereby the extract and solvent are heated to a temperature of about 55° C. to about 95° C. in step (vi).

18. The process of claim 14 or 15 whereby the extract and solvent are contacted with from about 1 to about 10 weight percent activated carbon particles in step (iv).

19. The process of claim 14 or 15 whereby the tobacco extract of step (iii) is contacted with a water soluble phosphate salt and/or an ammonia compound prior to step (iv).

20. A process for removing components from a tobacco extract, the process comprising the steps of:

(i) extracting components from a tobacco material under extraction conditions using an extraction solvent having an aqueous character, so as to provide an aqueous tobacco extract and a tobacco portion insoluble in the solvent;

(ii) separating at least a portion of the aqueous tobacco extract from the tobacco portion insoluble in the solvent;

(iii) providing the separated tobacco extract within extraction solvent in an amount of at least about 30 weight parts extract per weight part of solvent;

(iv) reducing the temperature of the extract and solvent from ambient temperature to less than the freezing point of the extract and solvent; and (v) separating resulting precipitate from the extract and solvent;

(vi) contacting the extract and solvent with activated carbon particles;

(vii) separating at least a portion of the extract and solvent from the activated carbon particles.

21. The process of claim 20 whereby the tobacco material includes Burley tobacco stem and the precipitate includes potassium nitrate crystals.

22. The process of claim 20 or 21 whereby the temperature of the extract and solvent is reduced to less than 0° C.

23. The process of claim 20 or 21 whereby the extract and solvent are contacted with from about 1 to about 10 weight percent activated carbon particles in step (vi).

24. The process of claim 20 or 21 whereby the tobacco extract of step (iii) is contacted with a water soluble phosphate salt and/or an ammonia compound prior to step (iv).

* * * * *

UNITED STATES PATENT AND TRADEMARK OFFICE

CERTIFICATE OF CORRECTION

PATENT NO. : 5,243,999

DATED : September 14, 1993

INVENTOR(S) : Leigh Ann B. Smith

It is certified that error appears in the above-indentified patent and that said Letters Patent is hereby corrected as shown below:

On the title page, Item [56] References Cited:

U.S. PATENT DOCUMENTS

| | | |
|---|---|---|
| 3,390,688 | 7/1968 | Touey et al. |
| 3,616,801 | 11/1971 | Hind |
| 3,780,744 | 12/1973 | Neel et al. |
| 3,847,164 | 11/1974 | Mattina et al. |
| 3,995,646 | 12/1976 | DeBrunn et al. |
| 4,131,117 | 12/1978 | Kite et al. |
| 4,131,118 | 12/1978 | Gellatly et al. |
| 4,364,401 | 12/1982 | Keritsis |
| 4,566,469 | 1/1986 | Semp et al. |
| 5,025,812 | 6/1991 | Fagg et al. |

FOREIGN PATENT DOCUMENTS

| | | |
|---|---|---|
| 070 112 | 6/1982 | Europe |
| 076 642 | 9/1982 | Europe |

Signed and Sealed this

Twenty-fourth Day of May, 1994

Bruce Lehman

*Attest:*

BRUCE LEHMAN

*Attesting Officer*

*Commissioner of Patents and Trademarks*